US006696695B1

(12) United States Patent
Georgii

(10) Patent No.: US 6,696,695 B1
(45) Date of Patent: Feb. 24, 2004

(54) STORAGE CONTAINER FOR HAZARDOUS MATERIAL

(75) Inventor: Hans Georgii, London (GB)

(73) Assignee: Oyster International N.V., Curacao (AN)

( * ) Notice: Subject to any disclaimer, the term of this patent is extended or adjusted under 35 U.S.C. 154(b) by 0 days.

(21) Appl. No.: 09/856,901

(22) PCT Filed: Nov. 29, 1999

(86) PCT No.: PCT/SE99/02220

§ 371 (c)(1),
(2), (4) Date: May 29, 2001

(87) PCT Pub. No.: WO00/33320

PCT Pub. Date: Jun. 8, 2000

(30) Foreign Application Priority Data

Nov. 27, 1998 (SE) ..... 9804101

(51) Int. Cl.[7] ..... G21F 5/00; G21F 19/00; G21C 19/00

(52) U.S. Cl. ..... 250/506.1; 376/272; 588/16

(58) Field of Search ..... 250/506.1; 376/272; 588/16

(56) References Cited

U.S. PATENT DOCUMENTS 3,731,102 A 5/1973 Peterson
4,210,614 A * 7/1980 Kleimola ..... 261/124
4,326,918 A * 4/1982 Lapides ..... 376/272
4,623,510 A * 11/1986 Troy ..... 376/272
4,649,018 A * 3/1987 Waltersdorf et al. ..... 376/272
6,008,428 A * 12/1999 Georgii ..... 588/16
6,617,484 B1 * 9/2003 Tuite et al. ..... 588/16

FOREIGN PATENT DOCUMENTS

WO WO 91/05351 A1 4/1991
WO WO 96/21932 A1 7/1996

* cited by examiner

*Primary Examiner*—John R. Lee
*Assistant Examiner*—Paul M. Gurzo
(74) *Attorney, Agent, or Firm*—Browdy and Neimark, P.L.L.C.

(57) ABSTRACT

A storage container for hazardous material, especially heat-generating hazardous material, comprises a central elongate, generally cylindrical concrete body having an elongate, sealable interior cavity for accommodating the hazardous material and a cooling liquid in which the hazardous material is immersed. The cavity comprises a generally cylindrical storage section concentric with the concrete body and an expansion chamber in fluid communication with the storage section. The expansion chamber is located axially outside on end of the storage section and extends radially past the circumference of the storage section. It is dimensioned such that when the cavity is filled with a predetermined quantity of the cooling liquid, the cooling liquid completely fills the storage section while still leaving room for expansion of the cooling liquid in the expansion chamber.

6 Claims, 2 Drawing Sheets

STORAGE CONTAINER FOR HAZARDOUS MATERIAL

REFERENCE TO RELATED APPLICATIONS

The present application is the national stage under 35 U.S.C. 371 of international application PCT/SE99/02220, filed Nov. 29, 1999 which designated the United States, and which international application was published under PCT Article 21(2) in the English language.

This invention relates to a storage container for hazardous material, especially heat-generating and/or radiant material, such as nuclear fuel rods and the like, which needs to be safely stored for a short or long times, such as for brief periods or decades or even centuries.

Storage of hazardous material in storage containers according to the invention may be for so-called ultimate storage but is primarily intended for interim storage, that is, storage in cases in which it may be required to process, recycle or otherwise handle the hazardous material after it has been stored for a longer or shorter time, such as during the time when the material is awaiting or under transport from one place to another.

WO91/05351 discloses a system for submerged offshore storage of hazardous materials, especially radioactive materials. This system includes primary storage units in the form of generally cylindrical storage bodies having a central cavity for receiving the hazardous material, and a secondary storage unit in the form of a substantially larger concrete structure adapted to be lowered to a storage position on the seabed to receive a large number of the primary storage units. Both the primary storage units and the secondary storage unit have buoyancy tanks which can be filled with water or evacuated as desired, so that the units can be transported on the water surface to the storage site and lowered to the seabed and when necessary caused to resurface.

WO96/21932 discloses a prior art storage container of the kind indicated initially, which comprises an elongate generally cylindrical concrete body having an elongate, sealable central interior cavity for accommodating the hazardous material and a liquid coolant in which the hazardous material is immersed, the cavity comprising a generally cylindrical storage section concentric with the concrete body and at least one expansion chamber in fluid communication with the storage section. This storage container may serve as the primary storage unit in the above-mentioned prior art storage system, being then provided with suitable flotation means, or other systems for interim or ultimate storage of the hazardous material.

The prior art storage container disclosed in WO96/21932 includes a conduit system, embedded in the concrete, for natural circulation of a liquid coolant, typically water, filling the storage section in which a canister holding the hazardous material is placed. This conduit system transports heat from the central storage section to the surrounding outer parts of the concrete body so that the heat may be dissipated to a medium surrounding the concrete body, such as a body of water in which the storage container is submerged. It is necessary then that the storage container be in a position at the storage site such that it is substantially vertical so that the natural circulation of the liquid coolant may be as effective as possible.

Because of the embedded conduit system and the required radiation absorption capability, the diameter of the concrete body of the prior art storage container is large. As a consequence, it is difficult to transport the storage container once the hazardous material has been introduced in it and needs to be cooled. In effect, it is very difficult, and may even be may be impracticable, to transport the prior art storage container on a standard railway car or other standard ground-transport vehicle.

A primary object of the present invention is to provide a storage container of the kind indicated initially which is suited for use in cases where some cooling is required but the cooling requirement is not very demanding, so that it can be met by means of a cooling arrangement which does not include a special fluid conduit system for transferring heat from the central cavity to the exterior surface of the storage container. Such a reduced cooling requirement exists in many cases, such as during transport or short-term storage of individual nuclear fuel rods.

The background prior art relevant to the invention includes a storage container of the kind disclosed in WO96/21932, namely a storage container of the kind comprising an elongate generally cylindrical concrete body having an elongate, sealable central interior cavity for accommodating the hazardous material and a cooling liquid in which the hazardous material is immersed, the cavity comprising a generally cylindrical storage section concentric with the concrete body and at least one expansion chamber in fluid communication with the storage section.

In accordance with the invention, the above-indicated primary object is achieved with a storage container of the just-mentioned kind in which the expansion chamber is located axially outside one end of the storage section and extends radially past the circumference of the storage section.

In a storage container constructed in accordance with the invention it is possible to confine the liquid coolant to the central cavity, so that a conduit or other passage system allowing the liquid coolant to circulate between the central cavity and the outer part of the concrete body can be dispensed with, and still ensure that the liquid coolant always completely fills the storage section of the cavity and can expand and contract as required in response to temperature variations, regardless of the orientation of the storage container.

Accordingly, unlike the prior art storage container, the storage container of the invention need not necessarily be in an upright position during the storage period (which may be several years even in the case of interim storage). Instead, it may be in the position which is the most practical in each individual case, such as in a horizontal position during transport. By suitable dimensioning of the expansion chamber and suitable filling of the central cavity with a liquid coolant in connection with the introduction of the hazardous material and the sealing of the cavity, a complete filling of the storage section with the liquid coolant can always be ensured, regardless of the orientation or position of the storage container. Thereby an adequate heat transfer from all points of the hazardous material to the concrete body can be ensured.

Because of the position of the expansion chamber axially outside one end of the storage section, the diameter of the concrete body and thus of the entire storage container can be minimised. Even when the hazardous material is spent nuclear fuel rods, it therefore is often possible to restrict the diameter of the storage container to 120 cm, for example, so that two storage containers can be placed side by side on a railway car of standard width.

The invention will be described in more detail below with reference to the accompanying drawings, in which an exemplary embodiment is shown.

Figure 1:
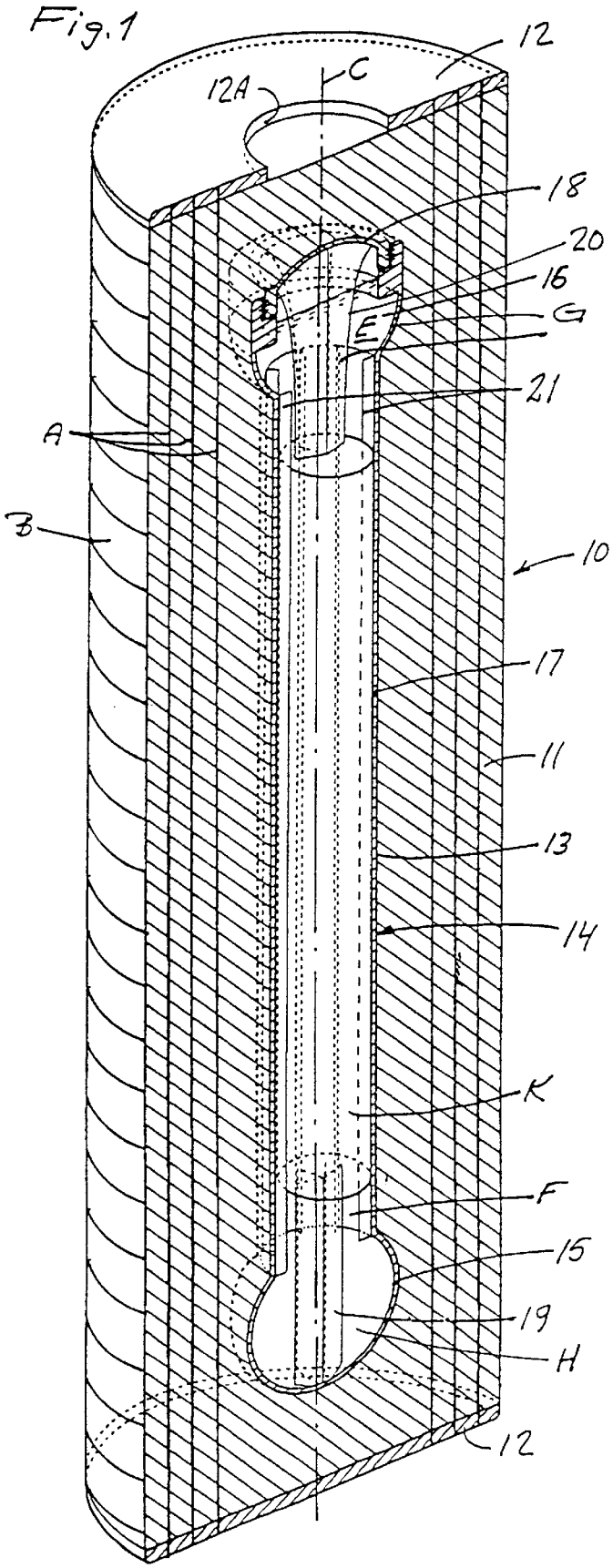
FIG. 1 is a perspective view showing a storage container according to the invention in axial section.

As shown in the drawings, the storage container 10 shown therein by way of example only, is in the shape of a straight circular cylinder the axis of which is designated by C. The storage container 10 includes a hollow concrete body 11 having at each end thereof a circular face plate 12, one of which, the upper face plate, is provided with a central hole 12A as shown in FIG. 1. The two face plates 12 serve as a protection for the end faces of the concrete body and as anchors for an axial steel reinforcement A embedded in the concrete.

A prestressed wire reinforcement B is wound about the outer circumferential surface of the concrete body 11 to prestress the concrete. If desired, the face plates 12 may extend radially past the outer circumferential surface of the concrete body 11.

An axially extending elongate cavity 13 formed in the concrete body 11 and centred on the axis C accommodates an inner receptacle, generally designated by 14, which defines a cavity E comprising a generally cylindrical elongate section F and a pair of axial extension chambers G and H. The cylindrical section F serves as a storage section for a cylindrical canister K, made of copper or other suitable material, which accommodates spent fuel rods, for example, and constitutes the hazardous material to be stored.

The concrete body 11 is formed by jointless embedding of the inner receptacle 14 in concrete, and the shape of the central cavity 13 in the concrete body thus exactly corresponds to the exterior shape of the inner receptacle 14.

Preferably, the concrete body 11, the length (height) and diameter of which may be, for example, 6 metres and 1.2 metres, respectively, is cast from ore concrete, that is, concrete the ballast of which mainly consists of iron ore, which has a high capability of absorbing radiation from radioactive materials.

The inner receptacle 14 may be made from metal, such as stainless steel, or a suitable plastics material, either as a single integral piece (except for the separate cover mentioned below) or assembled from a plurality of interconnected parts. Throughout the major part of its length, the inner receptacle 14 is cylindrical with a circular cross-section and a diameter which is from approximately one-third to one-half of the outer diameter of the concrete body 11. Both at the lower end and the upper end thereof, the cylindrical part merges with an axial extension part 15, 16. The lower extension part 15 is integral or solidly joined with the cylindrical wall 17 of the cylindrical part, whereas the top side of the upper extension part 16 is provided with a separate cover 18 which is secured to that extension part, such as by a threaded connection, bolts or other suitable means, to form a hermetic seal with it.

The parts 15, 16 of the inner receptacle 14 which define the extension chambers G, H of the cavity E are not merely axial extensions of the cylindrical wall 17. Their inner diameter is larger than the inner diameter of the cylindrical wall 17. Accordingly, throughout the circumference thereof, the extension chambers G, H formed by the extension parts 15, 16 also extend radially past the storage section F defined by the inner circumference of the cylindrical wall 17.

The shape and the dimensions of the extension chambers G, H are chosen such that when the cavity E of the inner receptacle 14 is filled to a predetermined degree with a liquid coolant, such as water, of a predetermined minimum temperature, the canister K in the cylindrical storage section F will be completely submerged in the liquid coolant regardless of the orientation (vertical, horizontal or inclined) of the storage container 10, and at the same time there will remain a certain space in the extension chambers G, H for accommodating thermal expansion of the liquid coolant. Accordingly, regardless of the orientation of the storage container 10 every point of the canister K is contacted by the liquid coolant, which is substantially freely movable within the inner receptacle 14.

Suitably, at normal temperature (room temperature) and with the predetermined degree of filling of the cavity E with the liquid coolant, the volume of the expansion space in the inner receptacle 14 is at least about 2 percent of the volume of the cavity. Preferably, however, the aforesaid volume is substantially larger, such as 4 to 6 percent of the volume of the cavity E.

Both at the lower and the upper end of the inner receptacle 14 there is a spacer element 19, 20 which serves to keep the canister K axially centred in the cylindrical storage section F of the cavity E. These spacer elements 21, 22 are shaped and positioned such that they do not appreciably restrict the movement of the liquid coolant in the inner receptacle.

Figure 2:
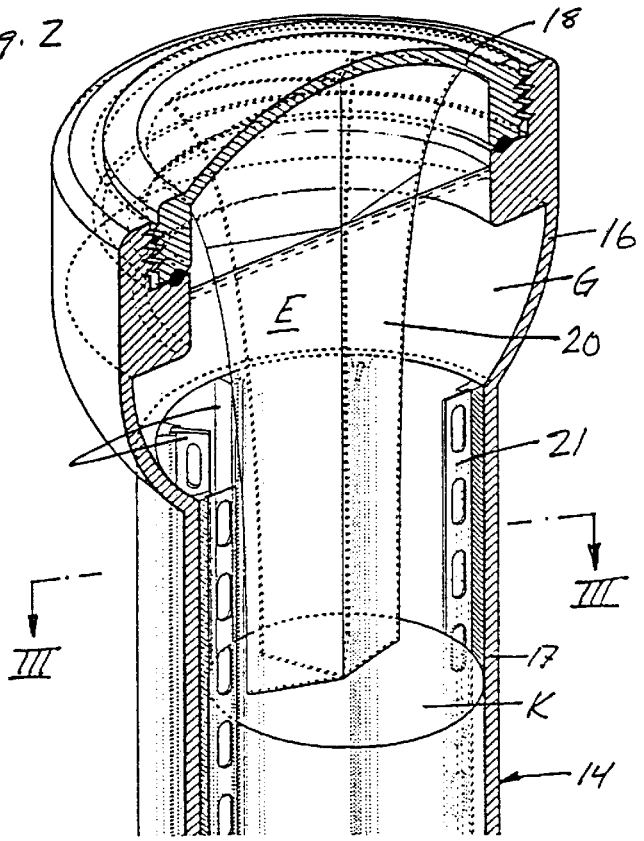
FIG. 2 is an enlarged perspective view of the upper portion of an inner receptacle incorporated in the storage container of FIG. 1.
Figure 3:
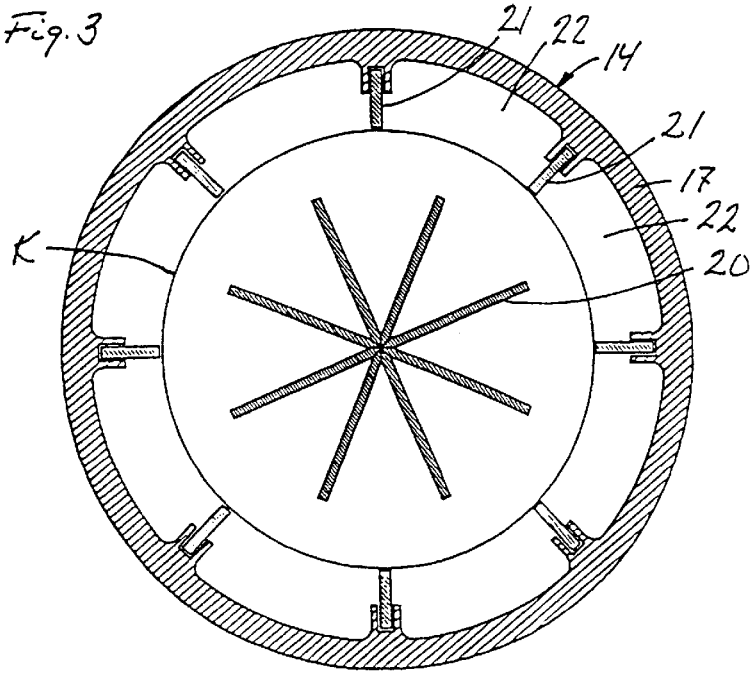
FIG. 3 is a sectional view taken along line III—III of FIG. 2.

The canister K is centred within the cylindrical storage section F of the cavity E by a plurality of longitudinal flanges or webs 21 disposed in radial planes as shown in FIG. 3. Like the spacer elements 19, 20, these webs or flanges 21 may be made of stainless steel, for example. They form axial channels 22 which are open toward the canister K and the expansion spaces formed by the extension chambers G and H, thereby facilitating movement of the liquid coolant within the cavity E. Movement of the liquid coolant is further facilitated by openings provided in the webs 21 as shown in FIG. 2 and/or in the ribs in which the webs are secured.

When the canister K is to be enclosed in the storage container 10, it is first placed in the inner receptacle 14 so as to rest on the lower spacer element 19 whereupon the upper spacer element 20 is placed on top of the canister and the inner receptacle is filled with liquid coolant to a predetermined level, such as to the brim. This operation is carried out when the inner receptacle 14, the canister K and the liquid coolant, preferably also the entire concrete body 11, are at a predetermined temperature. Then the cover 18 is applied and secured. As shown in FIGS. 1 and 2, the cover 18 is domed so that even when the inner receptacle 14 is filled to the brim, there remains an air pocket of a predetermined volume between the inside of the cover and the liquid coolant.

The inner receptacle 14 is then placed, preferably in an upright position, in a formwork in which the axial reinforcement A has been placed and prestressed. After concrete has been poured and allowed to harden, the formwork is removed and the radial reinforcement B is wound about the concrete body 11. If desired, a protective layer can then be applied around the wound radial reinforcement B. In connection with the casting of the concrete body 11, elements (not shown) for facilitating lifting and other handling of the storage container 10 are applied.

If at any future time the canister K has to be removed from the storage container 10, a hole centred on the axis is bored axially through the upper end of the concrete body. The boring is suitably carried out such that the entire cover 18 can be removed and reused. Alternatively, the hole may be bored through the cover and have a size such that the canister can be lifted from the inner receptacle 14 through the hole.

The storage container 10 may be provided with devices, positioned in one of the face plates 12 or embedded in the concrete, for example, which enable the storage container or the canister K to be identified and monitored remotely, e.g. from a satellite.

What is claimed is:

1. A storage container (10) for hazardous material, especially heat-generating hazardous material, comprising an elongate, generally cylindrical concrete body (11) having a central elongate, sealable interior cavity (13,E) for accommodating the hazardous material and a cooling liquid in which the hazardous material is immersed, the cavity (13,E) comprising a generally cylindrical storage section (F) concentric with the concrete body and at least one expansion chamber (G, H) in fluid communication with the storage section, characterised in that the expansion chamber G, H) is located axially outside one end of the storage section (F) and extends radially past the circumference of the storage section (F).

2. A storage container according to claim 1 including a hermetically sealable inner receptacle (14) enclosed in the concrete body (11), the interior of the inner receptacle (14) defining the storage section (F) and the expansion chamber (G, H).

3. A storage container according to claim 2, in which the inner receptacle (14) comprises a cylindrical wall portion (17) defining the storage section (F) and an axially adjoining extension part (15, 16) defining at least a part of the expansion chamber (G, H).

4. A storage container according to claim 1 or 2, in which one end of the inner receptacle (14) includes a closure element (18).

5. A storage container according to at least one of claims 2–4, in which the cylindrical wall (17) of the inner receptacle (14) is provided with a pluraity of circumferentially spaced-apart axially elongate inwardly directed webs or flanges (21) the inner ends of which are situated on an imaginary cylinder surface concentric with the concrete body (11) and which define between them channels (22) communicating with the expansion chamber (G, H).

6. A storage container according to at least one of claims 1–5, in which an additional expansion chamber (H, G) is provided axially outside the end of the cylindrical storage section (F) which is opposite to the said one end, the additional extension chamber (H, G) extending radially past the circumference of the storage section (F).

* * * * *